US009442463B2

(12) United States Patent
Seidel

(10) Patent No.: US 9,442,463 B2
(45) Date of Patent: Sep. 13, 2016

(54) TIME-TO-DIGITAL CONVERTER (TDC) WITH OFFSET CANCELLATION

(71) Applicant: Mark N. Seidel, Florence, AZ (US)

(72) Inventor: Mark N. Seidel, Florence, AZ (US)

(73) Assignee: Intel Corporation, Santa Clara, CA (US)

( * ) Notice: Subject to any disclaimer, the term of this patent is extended or adjusted under 35 U.S.C. 154(b) by 111 days.

(21) Appl. No.: 14/134,310

(22) Filed: Dec. 19, 2013

(65) Prior Publication Data

US 2015/0177701 A1 Jun. 25, 2015

(51) Int. Cl.
*G04F 10/00* (2006.01)

(52) U.S. Cl.
CPC ..... *G04F 10/005* (2013.01)

(58) Field of Classification Search
None
See application file for complete search history.

(56) References Cited

U.S. PATENT DOCUMENTS

2010/0244971 A1* 9/2010 Wang et al. ..... 331/1 A
2010/0264993 A1* 10/2010 Wang et al. ..... 331/1 A
2010/0328130 A1* 12/2010 Bulzacchelli et al. ..... 341/166

* cited by examiner

*Primary Examiner* — Noel Beharry
*Assistant Examiner* — Wilfred Thomas
(74) *Attorney, Agent, or Firm* — Blakely, Sokoloff, Taylor & Zafman LLP

(57) ABSTRACT

Described is an apparatus which comprises: a switching device to receive first and second inputs, and to generate first and second outputs; and a time-to-digital converter (TDC) core to receive the first and second outputs, and to generate a third output, wherein the switching device is operable to couple the first input to the first output or to couple the first input to the second output according to a control input.

13 Claims, 5 Drawing Sheets

TIME-TO-DIGITAL CONVERTER (TDC) WITH OFFSET CANCELLATION

BACKGROUND

A time-to-digital converter (TDC) translates a time difference between two input timing signals into a digital output bus. Depending on architecture, a TDC may function as a phase detector, a frequency detector, or both. A TDC monitors two digital timing signals and decides which timing signal arrived first. A TDC optionally monitors two timing signals to determine and digitally encode the time difference between the timing signals. A TDC also produces an output signal or bus of signals that encodes the time difference of which timing signal arrived first.

Known TDCs suffer from inadequate resolution. For example, in all-digital phase locked loops, inadequate resolution may result in a static phase error, while in multiplying delay locked loops, inadequate resolution may result in deterministic jitter.

BRIEF DESCRIPTION OF THE DRAWINGS

The embodiments of the disclosure will be understood more fully from the detailed description given below and from the accompanying drawings of various embodiments of the disclosure, which, however, should not be taken to limit the disclosure to the specific embodiments, but are for explanation and understanding only.

DETAILED DESCRIPTION

Figure 1:
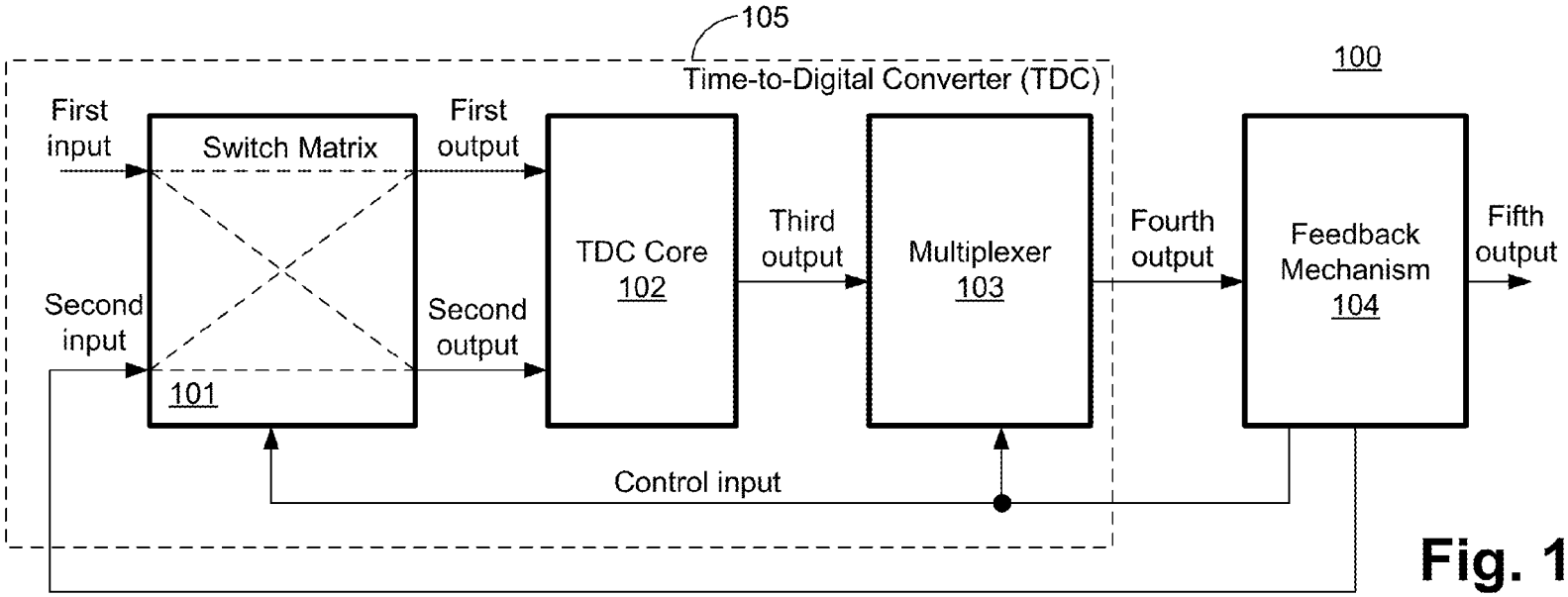
FIG. 1 illustrates a Time-to-Digital Converter (TDC) with Offset Cancellation, according to one embodiment of the disclosure.

The embodiments describe a Time-to-Digital Converter (TDC) in which a form of chopper-stabilization is applied. In one embodiment, two input timing signals to the TDC are repetitively swapped to average the timing offset in the TDC resulting in a zero or substantially zero time-delay difference.

In the following description, numerous details are discussed to provide a more thorough explanation of embodiments of the present disclosure. It will be apparent, however, to one skilled in the art, that embodiments of the present disclosure may be practiced without these specific details. In other instances, well-known structures and devices are shown in block diagram form, rather than in detail, in order to avoid obscuring embodiments of the present disclosure.

Note that in the corresponding drawings of the embodiments, signals are represented with lines. Some lines may be thicker, to indicate more constituent signal paths, and/or have arrows at one or more ends, to indicate primary information flow direction. Such indications are not intended to be limiting. Rather, the lines are used in connection with one or more exemplary embodiments to facilitate easier understanding of a circuit or a logical unit. Any represented signal, as dictated by design needs or preferences, may actually comprise one or more signals that may travel in either direction and may be implemented with any suitable type of signal scheme.

Throughout the specification, and in the claims, the term "connected" means a direct electrical connection between the things that are connected, without any intermediary devices. The term "coupled" means either a direct electrical connection between the things that are connected or an indirect connection through one or more passive or active intermediary devices. The term "circuit" means one or more passive and/or active components that are arranged to cooperate with one another to provide a desired function. The term "signal" means at least one current signal, voltage signal or data/clock signal. The meaning of "a," "an," and "the" include plural references. The meaning of "in" includes "in" and "on."

The term "scaling" generally refers to converting a design (schematic and layout) from one process technology to another process technology. The term "scaling" generally also refers to downsizing layout and devices within the same technology node. The term "scaling" may also refer to adjusting (e.g., slow down) of a signal frequency relative to another parameter, for example, power supply level. The terms "substantially," "close," "approximately," "near," and "about," generally refer to being within +/−20% of a target value.

Unless otherwise specified the use of the ordinal adjectives "first," "second," and "third," etc., to describe a common object, merely indicate that different instances of like objects are being referred to, and are not intended to imply that the objects so described must be in a given sequence, either temporally, spatially, in ranking or in any other manner.

For purposes of the embodiments, the transistors are metal oxide semiconductor (MOS) transistors, which include drain, source, gate, and bulk terminals. The transistors also include Tri-Gate and FinFET transistors, Gate All Around Cylindrical Transistors or other devices implementing transistor functionality like carbon nanotubes or spintronic devices. Source and drain terminals may be identical terminals and are interchangeably used herein. Those skilled in the art will appreciate that other transistors, for example, Bi-polar junction transistors—BJT PNP/NPN, BiCMOS, CMOS, eFET, etc., may be used without departing from the scope of the disclosure. The term "MN" indicates an n-type transistor (e.g., NMOS, NPN BJT, etc.) and the term "MP" indicates a p-type transistor (e.g., PMOS, PNP BJT, etc.).

FIG. 1 illustrates an apparatus 100 having TDC with Offset Cancellation, according to one embodiment of the disclosure. In one embodiment, apparatus 100 comprises Switch Matrix (of switching device) 101, TDC Core 102, Multiplexer unit 103, and Feedback Mechanism 104. In this embodiment, Switch Matrix 101, TDC Core 102, and Multiplexer unit 103 together form TDC 105. In another embodiment, Multiplexer unit 103 is internal to Feedback Mechanism 104. In another embodiment, Switch Matrix 101 and TDC Core 102 together form TDC 105.

In one embodiment, Switch Matrix 101 receives First and Second inputs and generates First and Second outputs according to a Control input. In one embodiment, Switch Matrix 101 comprises a plurality of pass-gate or multiplexers that are controllable by Control input to perform the function of chopping. For example, in one embodiment, Control input causes Switch Matrix 101 to couple First input to First output, and to couple Second input to Second output. In one embodiment, Control input causes Switch Matrix 101 to couple First input to Second output, and to couple Second input to First output. In one embodiment, when TDC is used as a phase detector for a phase locked loop (PLL) or a delay locked loop (DLL), First and Second inputs are Reference (Ref) and Feedback clock (Fb Clock) signals. Here, labels for nodes and signals are interchangeable. For example, First input refers to First input node or First input signal depending on context of the sentence.

In one embodiment, First and Second outputs are received by TDC Core 102 which compares arrival times of First and Second outputs to generate Third output. In one embodiment, TDC Core 102 monitors First and Second outputs (which are timing signals) to determine and digitally encode the time difference between the timing signals. In one embodiment, TDC Core 102 produces Third output or bus of signals that encodes the time difference of which timing signal between First and Second outputs arrived first. In one embodiment, TDC Core 102 is any known TDC unit. For example, TDC Core 102 is bang-bang TDC, a gate-delay TDC with single gate delay resolution, a vernier TDC with sub-gate delay resolution, etc. An embodiment of gate-delay TDC with single gate delay resolution is described with reference to FIGS. 3A-B, and an embodiment of vernier TDC is described with reference to FIGS. 4A-B. In these embodiments, inputs to the TDC are swappable or choppable to cancel timing offset in those TDCs.

Referring back to FIG. 1, in one embodiment, Multiplexer unit 103 receives Third output signal and selectively outputs either Third output signal as Fourth output or outputs an inverted version of Third output signal as Fourth output. In one embodiment, Multiplexer unit 103 is used for bang-bang TDCs. In one embodiment, for N-bit-output TDCs, a multiplexed bank of inverters (e.g., for a thermometer-encoded output) or a Negator or multiply-by-one block (e.g., in the case of a summation-encoded output) may be used. In one embodiment, Multiplexer unit 103 is a Negator. In one embodiment, Multiplexer unit 103 is controllable by a Control input generated by Feedback Mechanism 104. One embodiment of Multiplexer unit 103 is described with reference to FIGS. 2A-B.

Figure 2B:
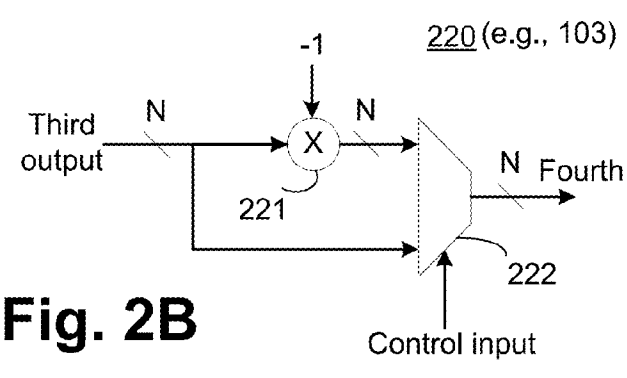
FIG. 2B illustrates a Multiplexer unit for use in the TDC of FIG. 1, according to another embodiment of the disclosure.
Figure 2A:
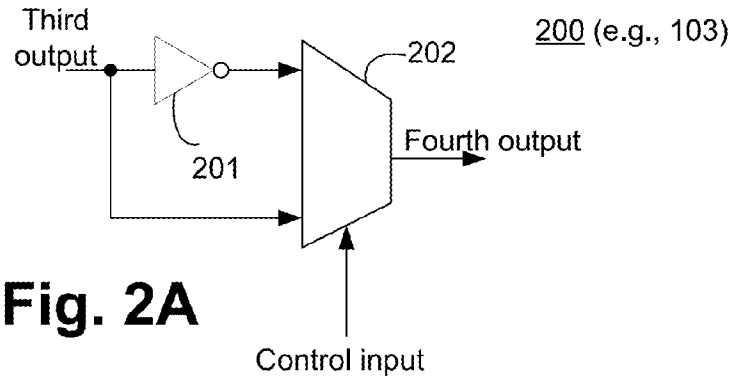
FIG. 2A illustrates a Multiplexer unit for use in the TDC of FIG. 1, according to one embodiment of the disclosure.

FIG. 2A illustrates a Multiplexer unit 200 (e.g., 103) for use in the TDC of FIG. 1, according to one embodiment of the disclosure. It is pointed out that those elements of FIG. 2A having the same reference numbers (or names) as the elements of any other figure can operate or function in any manner similar to that described, but are not limited to such. In one embodiment, Multiplexer unit 200 comprises an inverter 201 and multiplexer 202. In one embodiment, multiplexer 202 receives Third output and an inverted version of Third output (via inverter 201), and generates Fourth output. In one embodiment, Multiplexer unit 200 is used in a bang-bang TDC architecture.

FIG. 2B illustrates a Multiplexer unit 220 for use in the TDC of FIG. 1, according to another embodiment of the disclosure. In one embodiment, when the TDC has a multi-bit output (e.g., 4 bit value) then the Third Output is inverted by multiplying a "−1" to the Third Output. In this embodiment, Multiplexer unit 220 comprises a multiply-by-minus-one block 221 and an N-bit multiplexer 222 coupled together as shown. The multiply-by-minus-one block 221 multiplies a '−1' to the Third output before providing a first input to multiplexer 222. The second input to multiplexer 222 is Third output. In this case, Fourth output is an N-bit output and the Third output is an N-bit input. For example, when Third output is 'A', Multiplexer unit 220 outputs an N-bit value 'A' or "$2^N$−A", or just "−A" as Fourth output.

Referring back to FIG. 1, in one embodiment, Fourth output is received by Feedback Mechanism 104. Here, Fourth output indicates a time difference between arrival times of First and Second inputs. In one embodiment, Feedback Mechanism 104 generates an output (i.e., Fifth output) for use by downstream logic. In one embodiment, Feedback Mechanism 104 generates the Control input for Multiplexer 103 and Switch Matrix 101. In one embodiment, Feedback Mechanism 104 also provides Second input for Switch Matrix 101. In one embodiment, Feedback Mechanism is part of a PLL or DLL. In such an embodiment, Second input is a feedback clock.

In one embodiment, Feedback Mechanism 104 generates the Control input such that the two input timing signals (i.e., First and Second inputs) to TDC 105 are repetitively swapped to average the timing offset in TDC Core 102 resulting in a zero or substantially zero time-delay difference due to timing offset. In one embodiment, the frequency of switching or swapping of the two input timing signals is higher than the effective bandwidth of Feedback Mechanism 104. For example, if Feedback Mechanism 104 responds faster than the switching frequency, then the system corrects before the switch switches again, and the offset-cancellation benefit may be lost.

In another example, assume there is a positive timing offset in TDC Core 102. If Switch Matrix 101 were left in the flow-through condition (i.e., First input coupled to First output, and Second input coupled to Second output) then Fourth output settles to a condition where the First input (i.e., Ref Clock) is slightly leading the Second input (i.e., Fb Clock) by an amount close to that of the timing offset of TDC Core 102. When Switch Matrix 101 is configured via Control input in the crossed condition (i.e., First input is coupled to Second output, and Second input is coupled to First output), then Fourth output settles to a condition where First input (i.e., Ref Clock) slightly lags the Second input (i.e., Fb Clock) by the amount close to that of the timing offset. By continually switching the Switch Matrix 101 by Control input, the two offsets (i.e., leading and lagging offsets) are averaged and this cancels the effective offset of TDC Core 102, i.e., TDC 105 has cancelled offset.

Figure 3B:
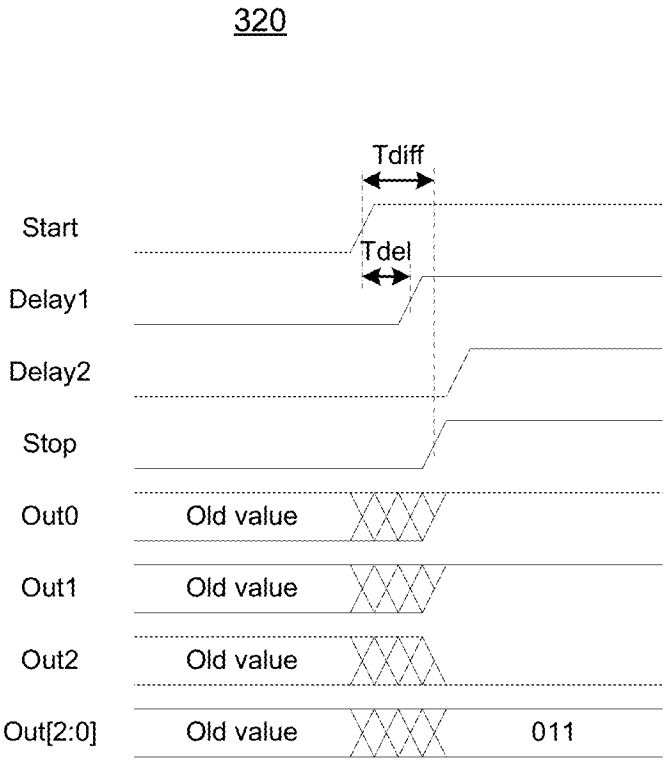
FIG. 3B illustrates a timing diagram showing the operation of the TDC Core of FIG. 3A, according to one embodiment of the disclosure.
Figure 3A:
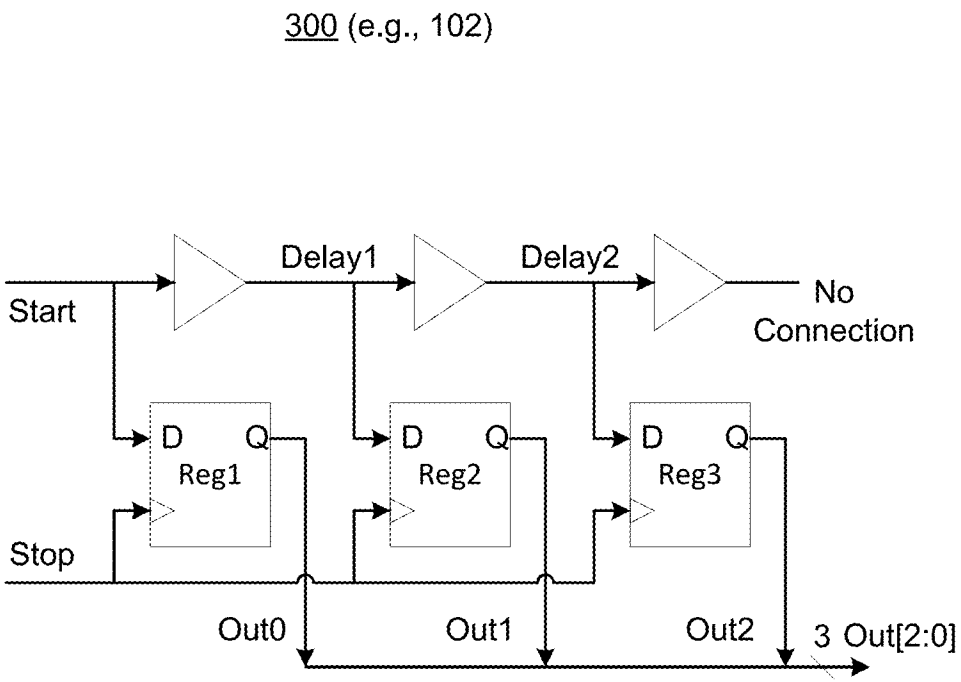
FIG. 3A illustrates a TDC Core for use in the TDC of FIG. 1, according to one embodiment of the disclosure.

FIG. 3A illustrates a TDC Core 300 for use in the TDC of FIG. 1, according to one embodiment of the disclosure. It is pointed out that those elements of FIG. 3A having the same reference numbers (or names) as the elements of any other figure can operate or function in any manner similar to that described, but are not limited to such.

In one embodiment, TDC Core 300 can receive swappable inputs to reduce time offset in the TDC. In one embodiment, TDC Core 300 (e.g., 102) comprises a plurality of sequential units (e.g., flip-flops) Reg1-RegN, where 'N' is an integer; and plurality of buffers. In this example, 'N' is three. In one embodiment, each buffer has a unit delay (i.e., Delay). For example, delay from first buffer is Delay1, delay from second buffer is Delay2, and so on. In one embodiment, Start signal (e.g., First output) is received as input for the first buffer and first sequential unit Reg1. The output of each buffer is received as input to the next buffer and as input to the next sequential unit. In this embodiment, Stop signal (e.g., Second output) is used as clock signal for each sequential unit. In one embodiment, output of each sequential unit is concatenated with the outputs from other sequential units into a bus to generate output Out.

Here, output Out is thermometer digital code of phase difference. It indicates a number of buffer delays between the clock edges of Start and Stop signals. In this example, the dynamic range of TDC Core 300 can be increased by adding more buffers. In one embodiment, Feedback Mechanism 104 generates the Control input such that the two input timing signals (i.e., First and Second outputs, where Start is First output and Stop is Second output) to TDC Core 300 are repetitively swapped to average the timing offset in TDC Core 300 resulting in a zero or substantially zero time-delay difference due to timing offset.

FIG. 3B illustrates a timing diagram 320 showing operation of TDC Core of FIG. 3A, according to one embodiment. It is pointed out that those elements of FIG. 3B having the same reference numbers (or names) as the elements of any other figure can operate or function in any manner similar to that described, but are not limited to such.

Timing diagram 320 shows propagation of Start signal (e.g., First output) through each buffer having a Delay equal to Tdel. When Stop signal (i.e., Second output) is asserted (i.e., it transitions from logical low to logical high), then sequential units latch in respective input data (i.e., Start signal and its delayed versions). The time difference between Start signal and Stop signal is Tdiff (e.g., phase difference between First and Second outputs). In this example, Tdiff is long enough to allow Start signal to propagate through two buffers i.e., Out0 and Out1 are latched as one while Out2 is latched as zero. The bit values (i.e., thermometer code) of bus Out[2:0] are shown as the last waveform with value "011."

Figure 4B:
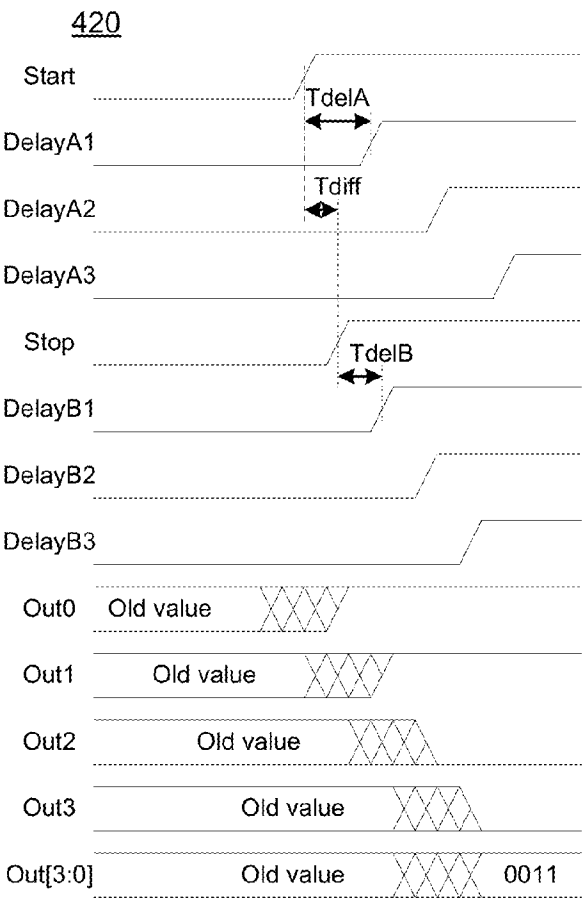
FIG. 4B illustrates a timing diagram showing the operation of the TDC Core of FIG. 4A, according to one embodiment of the disclosure.
Figure 4A:
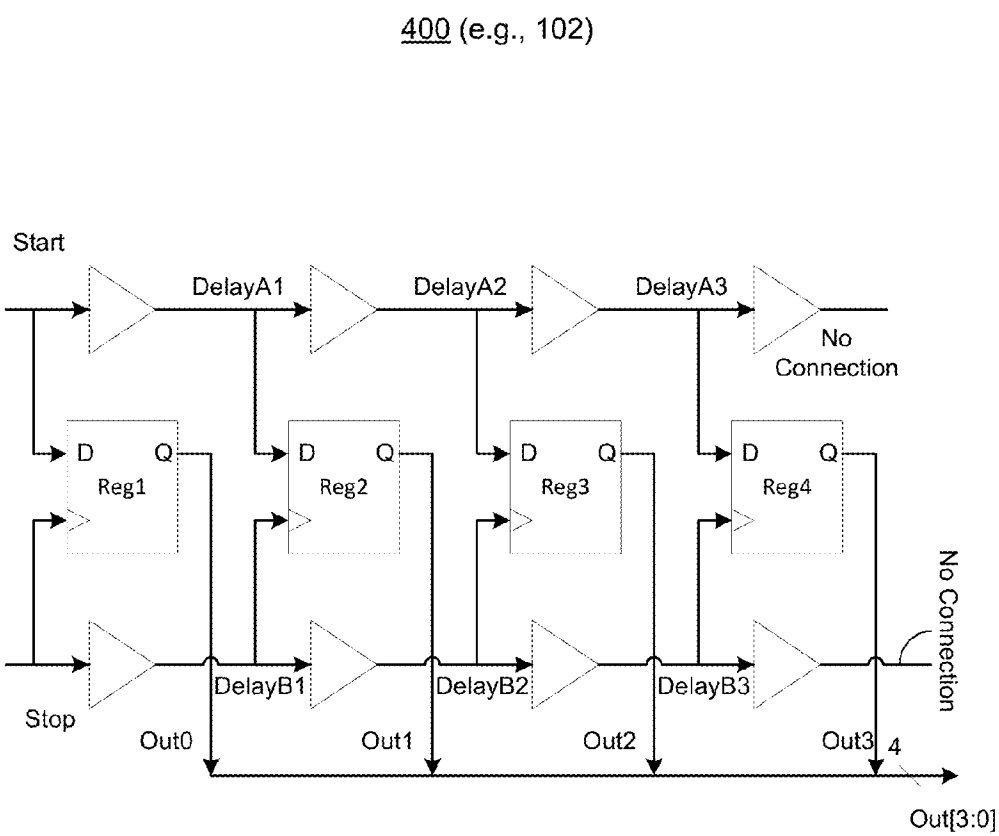
FIG. 4A illustrates a TDC Core for use in the TDC of FIG. 1, according to another embodiment of the disclosure.

FIG. 4A illustrates a TDC Core 400 for use in the TDC of FIG. 1, according to another embodiment of the disclosure. It is pointed out that those elements of FIG. 4A having the same reference numbers (or names) as the elements of any other figure can operate or function in any manner similar to that described, but are not limited to such. TDC Core 400 is described with reference to TDC Core 300. So as not to obscure the embodiments, differences between TDC Core 400 and TDC Core 300 are discussed.

In one embodiment, TDC Core 400 comprises a first plurality of delay cells (e.g., buffers), a second plurality of delay cells, and plurality of sequential units Reg1-RegN. Here, 'N' is equal to four. The delay of the first buffer of the first plurality of delay cells is DelayA1, delay of the second buffer of the first plurality of delay cells is DelayA2, delay of the third buffer of the first plurality of delay cells is DelayA3, and so on. The delay of the first buffer of the second plurality of delay cells is DelayB1, delay of the second buffer of the second plurality of delay cells is DelayB2, delay of the third buffer of the second plurality of delay cells is DelayB3, and so on. In this example, output of the fourth buffers of first and second plurality of delay cells is connected to a dummy load or is not connected to any logic.

Compared to TDC Core 300, TDC Core 400 includes a second plurality of delay cells (of buffers) on the Stop signal path. For example, Stop signal is received by a first delay cell of the second plurality and the first sequential unit Reg1. The first delay cell of the second plurality provides a delayed version of Stop signal to second sequential unit Reg2 and second delay cell of the second plurality, and so on. In this embodiment, each delay cell of the first plurality has a delay different from the delay of each cell of the second plurality. In this example, delay cells of the first plurality have a delay of TdelA while the delay cells of the second plurality have a delay of TdelB, where TdelB is different from TdelA.

In one embodiment, TDC Core 400 is a vernier TDC which achieves a resolution Tres as a difference between two gate delay values (i.e., Tres=TdelA−TdelB). TDC Core 400 delays both Start and Stop signals with delay chain. In this case, the resolution is not defined by the absolute rate of transitions but the relative rate of transitions. Here, the resolution is a difference between the buffer delays of the first plurality and the buffer delays of the second plurality.

FIG. 4B illustrates a timing diagram 420 showing operation of TDC Core of FIG. 3A, according to one embodiment. It is pointed out that those elements of FIG. 4B having the same reference numbers (or names) as the elements of any other figure can operate or function in any manner similar to that described, but are not limited to such.

Timing diagram 420 shows propagation of Start signal through each buffer having a Delay equal to TdelA. When Stop signal is asserted (i.e., it transitions from logical low to logical high in this example), then sequential units latch in a staggered fashion (i.e., staggered by TdelB of delay cells) respective input data (i.e., Start signal and its delayed versions). The time difference between Start signal and Stop signal is Tdiff (e.g., phase difference between First and Second outputs). The bit values of bus Out[3:0] are shown at bottom with value "0011."

Figure 5A:
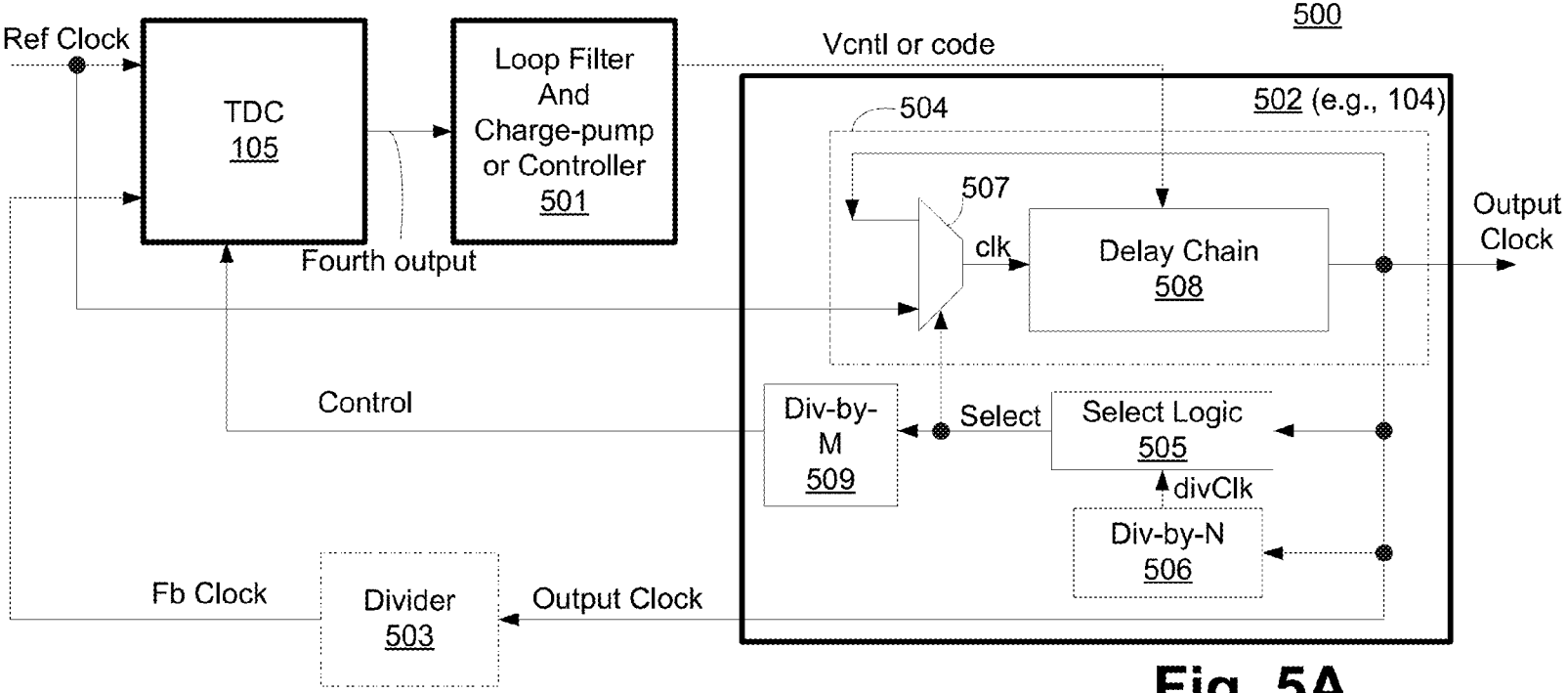
FIG. 5A illustrates an apparatus having a multiplying delay locked loop (MDLL) with the TDC of FIG. 1, according to one embodiment of the disclosure.

FIG. 5A illustrates an apparatus 500 having a multiplying delay locked loop (MDLL) with TDC of FIG. 1, according to one embodiment of the disclosure. It is pointed out that those elements of FIG. 5A having the same reference numbers (or names) as the elements of any other figure can operate or function in any manner similar to that described, but are not limited to such.

While the embodiment is explained with reference to an MDLL, the TDC of the embodiments can be used in any DLL, PLL, or other circuits. In one embodiment, apparatus 500 comprises TDC 105 (e.g., a phase detector), Loop Filter and Charge-pump or Controller 501, and Feedback Mechanism 502 (e.g., 104). In one embodiment, TDC 105 receives Ref Clock (i.e., First input) and Fb Clock (i.e., Second input) as inputs and generates Fourth output signal indicating a time difference between arrival times of Ref Clock and Fb Clock. In one embodiment, TDC 105 receives Control input from Feedback Mechanism 502 to cause switching or chopping of Ref Clock and Fb Clock to cancel timing offset in TDC 105.

In one embodiment, Fourth output signal is received by Loop Filter and Charge-pump or Controller 501. In this example, Loop Filter and Charge-pump or Controller are lumped together in a single unit. However, they can be implemented as separate units. In one embodiment, depending on the implementation of Loop Filter in 501, output of Loop Filter and Charge-pump or Controller 501 is an analog control voltage (Vcntl) or a digital code (code). In one embodiment, Vcntl or code is received by Feedback Mechanism 502 which generates Output Clock.

In one embodiment, Feedback Mechanism 502 comprises ring oscillator (RO) 504, Select Logic 505, and Divide-by-N (Div-by-N) divider 506. In one embodiment, RO 504 comprises a chain of delay cells coupled together in a series such that the output of the last delay cell is coupled to the input of the first delay cell. In one embodiment, RO 504 comprises a multiplexer 507 (i.e., first delay cell) and Delay Chain 508 (i.e., rest of the delay cells). In one embodiment, delay cells in Delay Chain 508 are operable to adjust their delays according to Vcntl or code signal.

In one embodiment, multiplexer 507 receives Output Clock from Delay Chain 508 and Ref Clock. In one embodiment, multiplexer 507 is operable, via Select signal, to select one of Output Clock or Ref Clock as output clk for Delay Chain 508. In one embodiment, Select signal is generated by Select Logic 505 which receives divClk from Div-by-N divider and generates a pulse every Nth cycle of Output Clock. In one embodiment, pulse width of Select signal is substantially equal to pulse width of a phase of Output Clock. In one embodiment, Control signal is generated by Div-by-M 509 (divider by 'M' where 'M' is an integer) which receives Select signal from Select Logic 505.

Figure 5B:
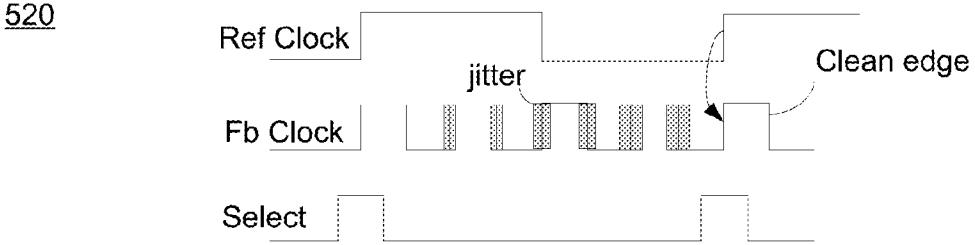
FIG. 5B illustrates a timing diagram showing the operation of the apparatus of FIG. 1, according to one embodiment of the disclosure.

FIG. 5B illustrates timing diagram 520 showing operation of apparatus of FIG. 1, according to one embodiment of the disclosure. It is pointed out that those elements of FIG. 5B having the same reference numbers (or names) as the elements of any other figure can operate or function in any manner similar to that described, but are not limited to such.

Here x-axis is time and y-axis is voltage. The first signal from the top is Ref Clock followed by Fb Clock and Select signal. In this embodiment, Fb Clock is same as Output Clock and Divider 503 is replaced with a wire shorting Output Clock node with Fb Clock node. In this example, 'N' is four and so divClk signal is a divide by four version of Output Clock. The shaded region around the edges of Fb Clock is jitter which accumulates (i.e., becomes larger) over time. In this embodiment, once four Output Clock cycles are counted by Div-by-N divider 506, Select Logic 505 generates a Select pulse. In one embodiment, Select signal causes Multiplexer 507 to include Ref Clock as clk for Delay Chain. In this embodiment, noisy Output Clock edge is replaced with clean Ref Clock to reduce jitter on Output Clock. In one embodiment, Control input signal switches faster than bandwidth of the loop of apparatus 500.

Referring back to FIG. 5A, in one embodiment, Control signal is also received by TDC 105 as Control input for switching or chopping Ref Clock with Fb Clock. In one embodiment, apparatus 500 is a digital multiplying DLL (i.e., MDLL). In such an embodiment, Charge-pump is replaced with a Controller, and Loop filter is a digital loop filter. In one embodiment, apparatus 500 is a PLL. In such an embodiment, apparatus 500 further comprises a Divider 503 which receives Output Clock from Feedback Mechanism 502 and generates a Fb Clock (feedback clock) have same frequency as the Ref Clock (i.e., reference clock). In one embodiment, apparatus 500 is a digital PLL. In such an embodiment, Charge-pump is replaced with a Controller, Loop filter is a digital loop filter, and Delay Chain may comprise digitally adjustable delay cells.

Figure 6:
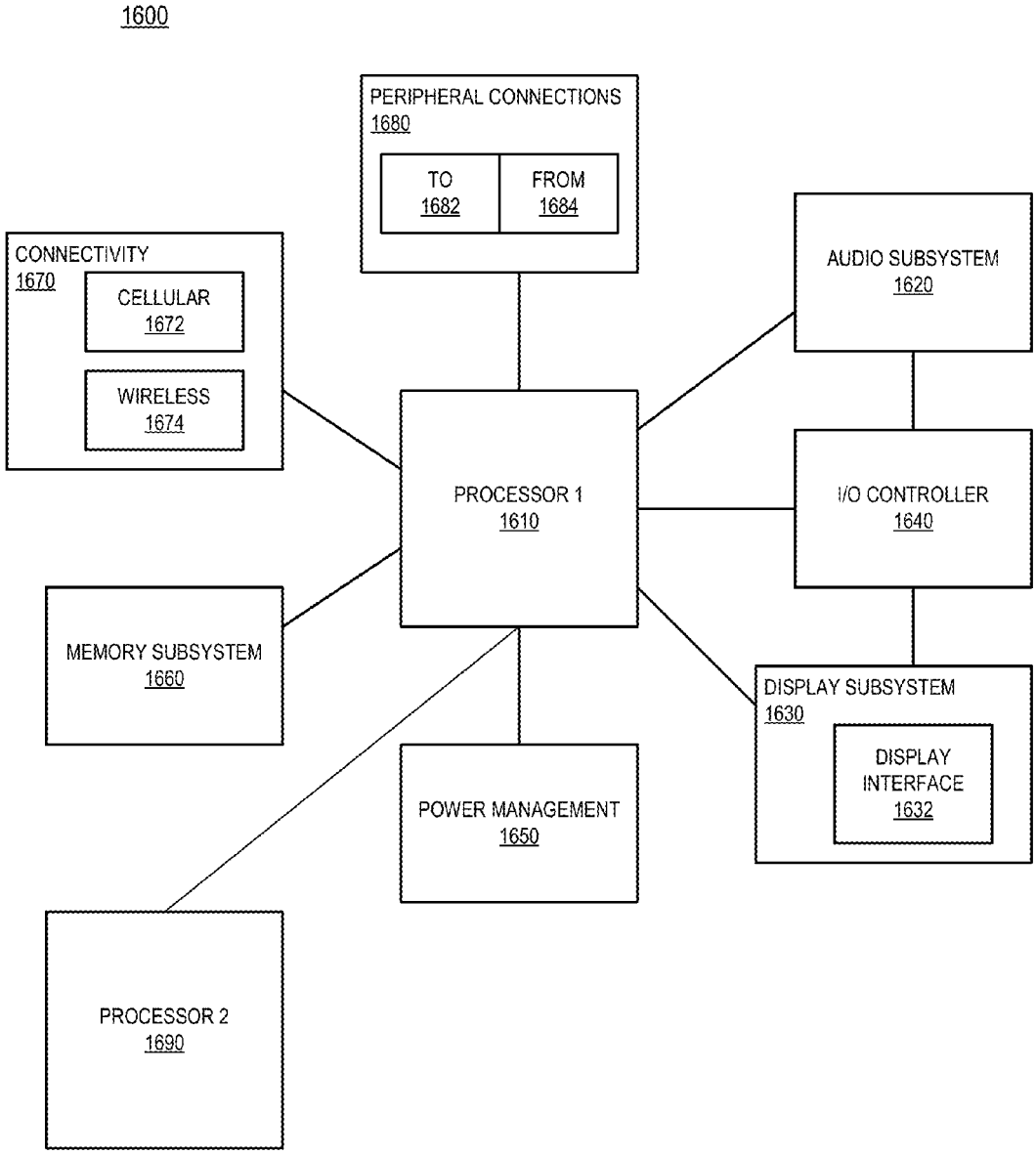
FIG. 6 is a smart device or a computer system or an SoC (System-on-Chip) with one or more TDCs having apparatus for offset cancellation, according to one embodiment of the disclosure.

FIG. 6 is a smart device or a computer system or an SoC (System-on-Chip) with TDC having apparatus for offset cancellation, according to one embodiment of the disclosure. It is pointed out that those elements of FIG. 6 having the same reference numbers (or names) as the elements of any other figure can operate or function in any manner similar to that described, but are not limited to such.

FIG. 6 illustrates a block diagram of an embodiment of a mobile device in which flat surface interface connectors could be used. In one embodiment, computing device 1600 represents a mobile computing device, such as a computing tablet, a mobile phone or smart-phone, a wireless-enabled e-reader, or other wireless mobile device. It will be understood that certain components are shown generally, and not all components of such a device are shown in computing device 1600.

In one embodiment, computing device 1600 includes a first processor 1610 with TDC having apparatus for offset cancellation described with reference to embodiments. Other blocks of the computing device 1600 may also include TDC having apparatus for offset cancellation described with reference to embodiments. The various embodiments of the present disclosure may also comprise a network interface within 1670 such as a wireless interface so that a system embodiment may be incorporated into a wireless device, for example, cell phone or personal digital assistant.

In one embodiment, processor 1610 (and processor 1690) can include one or more physical devices, such as microprocessors, application processors, microcontrollers, programmable logic devices, or other processing means. Processor 1690 may be optional. The processing operations performed by processor 1610 include the execution of an operating platform or operating system on which applications and/or device functions are executed. The processing operations include operations related to I/O (input/output) with a human user or with other devices, operations related to power management, and/or operations related to connecting the computing device 1600 to another device. The processing operations may also include operations related to audio I/O and/or display I/O.

In one embodiment, computing device 1600 includes audio subsystem 1620, which represents hardware (e.g., audio hardware and audio circuits) and software (e.g., drivers, codecs) components associated with providing audio functions to the computing device. Audio functions can include speaker and/or headphone output, as well as microphone input. Devices for such functions can be integrated into computing device 1600, or connected to the computing device 1600. In one embodiment, a user interacts with the computing device 1600 by providing audio commands that are received and processed by processor 1610.

Display subsystem 1630 represents hardware (e.g., display devices) and software (e.g., drivers) components that provide a visual and/or tactile display for a user to interact with the computing device 1600. Display subsystem 1630 includes display interface 1632, which includes the particular screen or hardware device used to provide a display to a user. In one embodiment, display interface 1632 includes logic separate from processor 1610 to perform at least some processing related to the display. In one embodiment, display subsystem 1630 includes a touch screen (or touch pad) device that provides both output and input to a user.

I/O controller 1640 represents hardware devices and software components related to interaction with a user. I/O controller 1640 is operable to manage hardware that is part of audio subsystem 1620 and/or display subsystem 1630. Additionally, I/O controller 1640 illustrates a connection point for additional devices that connect to computing device 1600 through which a user might interact with the system. For example, devices that can be attached to the computing device 1600 might include microphone devices, speaker or stereo systems, video systems or other display devices, keyboard or keypad devices, or other I/O devices for use with specific applications such as card readers or other devices.

As mentioned above, I/O controller 1640 can interact with audio subsystem 1620 and/or display subsystem 1630. For example, input through a microphone or other audio device can provide input or commands for one or more applications or functions of the computing device 1600. Additionally, audio output can be provided instead of, or in addition to display output. In another example, if display subsystem 1630 includes a touch screen, the display device also acts as an input device, which can be at least partially managed by I/O controller 1640. There can also be additional buttons or switches on the computing device 1600 to provide I/O functions managed by I/O controller 1640.

In one embodiment, I/O controller 1640 manages devices such as accelerometers, cameras, light sensors or other environmental sensors, or other hardware that can be included in the computing device 1600. The input can be part of direct user interaction, as well as providing environmental input to the system to influence its operations (such as filtering for noise, adjusting displays for brightness detection, applying a flash for a camera, or other features).

In one embodiment, computing device 1600 includes power management 1650 that manages battery power usage, charging of the battery, and features related to power saving operation. Memory subsystem 1660 includes memory devices for storing information in computing device 1600. Memory can include nonvolatile (state does not change if power to the memory device is interrupted) and/or volatile (state is indeterminate if power to the memory device is interrupted) memory devices. Memory subsystem 1660 can store application data, user data, music, photos, documents, or other data, as well as system data (whether long-term or temporary) related to the execution of the applications and functions of the computing device 1600.

Elements of embodiments are also provided as a machine-readable medium (e.g., memory 1660) for storing the computer-executable instructions (e.g., instructions to implement any other processes discussed herein). The machine-readable medium (e.g., memory 1660) may include, but is not limited to, flash memory, optical disks, CD-ROMs, DVD ROMs, RAMs, EPROMs, EEPROMs, magnetic or optical cards, phase change memory (PCM), or other types of machine-readable media suitable for storing electronic or computer-executable instructions. For example, embodiments of the disclosure may be downloaded as a computer program (e.g., BIOS) which may be transferred from a remote computer (e.g., a server) to a requesting computer (e.g., a client) by way of data signals via a communication link (e.g., a modem or network connection).

Connectivity 1670 includes hardware devices (e.g., wireless and/or wired connectors and communication hardware) and software components (e.g., drivers, protocol stacks) to enable the computing device 1600 to communicate with external devices. The computing device 1600 could be separate devices, such as other computing devices, wireless access points or base stations, as well as peripherals such as headsets, printers, or other devices.

Connectivity 1670 can include multiple different types of connectivity. To generalize, the computing device 1600 is illustrated with cellular connectivity 1672 and wireless connectivity 1674. Cellular connectivity 1672 refers generally to cellular network connectivity provided by wireless carriers, such as provided via GSM (global system for mobile communications) or variations or derivatives, CDMA (code division multiple access) or variations or derivatives, TDM (time division multiplexing) or variations or derivatives, or other cellular service standards. Wireless connectivity (or wireless interface) 1674 refers to wireless connectivity that is not cellular, and can include personal area networks (such as Bluetooth, Near Field, etc.), local area networks (such as Wi-Fi), and/or wide area networks (such as WiMax), or other wireless communication.

Peripheral connections 1680 include hardware interfaces and connectors, as well as software components (e.g., drivers, protocol stacks) to make peripheral connections. It will be understood that the computing device 1600 could both be a peripheral device ("to" 1682) to other computing devices, as well as have peripheral devices ("from" 1684) connected to it. The computing device 1600 commonly has a "docking" connector to connect to other computing devices for purposes such as managing (e.g., downloading and/or uploading, changing, synchronizing) content on computing device 1600. Additionally, a docking connector can allow computing device 1600 to connect to certain peripherals that allow the computing device 1600 to control content output, for example, to audiovisual or other systems.

In addition to a proprietary docking connector or other proprietary connection hardware, the computing device 1600 can make peripheral connections 1680 via common or standards-based connectors. Common types can include a Universal Serial Bus (USB) connector (which can include any of a number of different hardware interfaces), DisplayPort including MiniDisplayPort (MDP), High Definition Multimedia Interface (HDMI), Firewire, or other types.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may," "might," or "could" be included, that particular component, feature, structure, or characteristic is not required to be included. If the specification or claim refers to "a" or "an" element, that does not mean there is only one of the elements. If the specification or claims refer to "an additional" element, that does not preclude there being more than one of the additional element.

Furthermore, the particular features, structures, functions, or characteristics may be combined in any suitable manner in one or more embodiments. For example, a first embodiment may be combined with a second embodiment anywhere the particular features, structures, functions, or characteristics associated with the two embodiments are not mutually exclusive.

While the disclosure has been described in conjunction with specific embodiments thereof, many alternatives, modifications and variations of such embodiments will be apparent to those of ordinary skill in the art in light of the foregoing description. For example, other memory architectures e.g., Dynamic RAM (DRAM) may use the embodiments discussed. The embodiments of the disclosure are intended to embrace all such alternatives, modifications, and variations as to fall within the broad scope of the appended claims.

In addition, well known power/ground connections to integrated circuit (IC) chips and other components may or may not be shown within the presented figures, for simplicity of illustration and discussion, and so as not to obscure the disclosure. Further, arrangements may be shown in block diagram form in order to avoid obscuring the disclosure, and also in view of the fact that specifics with respect to implementation of such block diagram arrangements are highly dependent upon the platform within which the present disclosure is to be implemented (i.e., such specifics should be well within purview of one skilled in the art). Where specific details (e.g., circuits) are set forth in order to describe example embodiments of the disclosure, it should be apparent to one skilled in the art that the disclosure can be practiced without, or with variation of, these specific details. The description is thus to be regarded as illustrative instead of limiting.

The following examples pertain to further embodiments. Specifics in the examples may be used anywhere in one or more embodiments. All optional features of the apparatus described herein may also be implemented with respect to a method or process.

For example, an apparatus is provided which comprises: a switching device to receive first and second inputs, and to generate first and second outputs; and a time-to-digital converter (TDC) core to receive the first and second outputs, and to generate a third output, wherein the switching device is operable to couple the first input to the first output or to couple the first input to the second output according to a control input.

In one embodiment, the switching device is operable to couple the second input to the second output or to couple the second input to the first output according to the control input. In one embodiment, the apparatus further comprises a multiplexer to receive the third output and an inverted version of the third output, the multiplexer operable to select as fourth output one of the third output or the inverted version of the third output according to the control input. In one embodiment, the apparatus further comprises a feedback mechanism to receive the fourth output and to generate the control input.

In one embodiment, the feedback mechanism comprises: a ring oscillator to generate an oscillating signal; a first divider to receive the oscillating signal and to generate a first divided output; and a select logic to receive the oscillating signal and the divided output to generate the control input for controlling a multiplexer. In one embodiment, the multiplexer to receive the first input and the oscillating signal, and to generate an output which is received as input by the ring oscillator. In one embodiment, the first input is a reference clock, and wherein the second input is a feedback clock. In one embodiment, the TDC core is one of bang-bang TDC; gate-delay TDC; or vernier TDC.

In another example, a system is provided which comprises: a memory; a processor coupled to the memory, the processor having an apparatus according to the apparatus discussed above. In one embodiment, the system further comprises a display unit. In one embodiment, the display unit is a touch screen.

In another example, a time-to-digital converter (TDC) is provided which comprises: a switching device to receive first and second inputs, to generate first and second outputs, and operable to perform a chopping function; a TDC core to receive the first and second outputs, and to generate a third output; and a multiplexer to receive the third output and an inverted version of the third output, the multiplexer operable to select as fourth output one of the third output or the inverted version of the third output.

In one embodiment, the TDC core is one of: bang-bang TDC; gate-delay TDC; or vernier TDC. In one embodiment, the TDC further comprises a feedback mechanism to receive the fourth output and to generate a control signal for controlling the switching device and the multiplexer. In one embodiment, the feedback mechanism includes at least part of a phase locked loop or a delay locked loop.

In another example, a system is provided which comprises: a memory; a processor coupled to the memory, the processor having a TDC according to the TDC discussed above. In one embodiment, the system further comprises a display unit. In one embodiment, the display unit is a touch screen.

An abstract is provided that will allow the reader to ascertain the nature and gist of the technical disclosure. The abstract is submitted with the understanding that it will not be used to limit the scope or meaning of the claims. The following claims are hereby incorporated into the detailed description, with each claim standing on its own as a separate embodiment.

I claim:

1. An apparatus comprising:

a switching device to receive first and second inputs, and to generate first and second outputs;

a time-to-digital converter (TDC) core to receive the first and second outputs, and to generate a third output;

a feedback mechanism to generate a control input, wherein the switching device is operable to couple the first input to the first output and the second input to the second output or to couple the first input to the second output and the second input to the first output according to the control input to cancel timing offset in the TDC; and a multiplexer to receive the third output and an inverted version of the third output, the multiplexer operable to select as a fourth output to be received by the feedback mechanism one of the third output or the inverted version of the third output according to the control input.

2. The apparatus of claim 1, wherein the feedback mechanism comprises:

a ring oscillator to generate an oscillating signal;

a first divider to receive the oscillating signal and to generate a first divided output; and a select logic to receive the oscillating signal and the divided output to generate the control input for controlling a multiplexer.

3. The apparatus of claim 2, wherein the multiplexer to receive the first input and the oscillating signal, and to generate an output which is received as input by the ring oscillator.

4. The apparatus of claim 1, wherein the first input is a reference clock, and wherein the second input is a feedback clock from the feedback mechanism.

5. The apparatus of claim 1, wherein the TDC core is one of:

bang-bang TDC;

gate-delay TDC; or vernier TDC.

6. A time-to-digital converter (TDC) comprising:

a switching device to receive first and second inputs and to generate first and second outputs, a TDC core to receive the first and second outputs, and to generate a third output;

a multiplexer to receive the third output and an inverted version of the third output; and a feedback mechanism to generate a control signal, wherein the multiplexer is operable to select as fourth output to be received by the feedback mechanism one of the third output or the inverted version of the third output according to the control input, and the switching device is operable to couple the first input to the first output and the second input to the second output or to couple the first input to the second output and the second input to the first output according to the control input to cancel timing offset in the TDC;

the multiplexer operable to select as a fourth output to be received by the feedback mechanism one of the third output or the inverted version of the third output according to the control input.

7. The TDC of claim 6, wherein the TDC core is one of:

bang-bang TDC;

gate-delay TDC; or vernier TDC.

8. The TDC of claim 6, wherein the feedback mechanism includes at least part of a phase locked loop or a delay locked loop.

9. A system comprising:

a memory;

a processor coupled to the memory, the processor having an apparatus which comprises:

a switching device to receive first and second inputs, and to generate first and second outputs;

a time-to-digital converter (TDC) core to receive the first and second outputs, and to generate a third output, and a feedback mechanism to generate a control input, wherein the switching device is operable to couple the first input to the first output and the second input to the second output or to couple the first input to the second output and the second input to the first output according to the control input to cancel timing offset in the TDC; and a multiplexer to receive the third output and an inverted version of the third output, the multiplexer operable to select as fourth output to be received by the feedback mechanism one of the third output or the inverted version of the third output according to a select input, and a wireless interface for allowing the processor to couple to another device.

10. The system of claim 9, further comprises a display unit.

11. The system of claim 9, wherein the feedback mechanism comprises:

a ring oscillator to generate an oscillating signal;

a first divider to receive the oscillating signal and to generate a first divided output; and a select logic to receive the oscillating signal and the first divided output generate the select input for controlling a multiplexer.

12. The system of claim 9, wherein the feedback mechanism includes at least part of a phase locked loop or a delay locked loop.

13. The system of claim 9, wherein the TDC core is one of:

bang-bang TDC;

gate-delay TDC; or vernier TDC.

* * * * *